United States Patent [19]

Hoekman

[11] 4,277,693

[45] Jul. 7, 1981

[54] APPARATUS FOR PROVIDING A TIME CONTROLLED OUTPUT

[75] Inventor: Earl B. Hoekman, Roseville, Minn.

[73] Assignee: Minnesota Mining and Manufacturing Company, St. Paul, Minn.

[21] Appl. No.: 94,925

[22] Filed: Nov. 16, 1979

[51] Int. Cl.[3] ..... H01H 43/00

[52] U.S. Cl. ..... 307/141; 328/48; 307/269; 307/219; 331/55

[58] Field of Search ..... 307/141, 64, 65, 66, 307/67, 68, 87, 219, 269, 141.4; 331/55, 46; 328/44, 48, 63

[56] References Cited

U.S. PATENT DOCUMENTS

| | | | |
|---|---|---|---|
| 4,145,617 | 3/1979 | Lee et al. | 307/141 X |
| 4,156,200 | 5/1979 | Gomez | 307/269 X |
| 4,213,064 | 7/1980 | Nagano | 328/48 X |

*Primary Examiner*—L. T. Hix
*Assistant Examiner*—James L. Dwyer
*Attorney, Agent, or Firm*—Cruzan Alexander; Donald M. Sell; William D. Bauer

[57] ABSTRACT

An apparatus for providing a time-controlled output based primarily upon a primary time source and secondarily upon a secondary time source, the secondary time source counted down to the desired frequency of the time-controlled output. A sensor supplies a control circuit which outputs the primary time source signal when the primary time source is operative, and the secondary time source signal when the primary time source is not operative. The output of the control circuit then resets the appropriate segment of the secondary time source counter in order to synchronize the time-controlled output for the primary time source when the primary time source is operative.

17 Claims, 9 Drawing Figures

PRIMARY TIME OPERATIVE

PRIMARY TIME INOPERATIVE

APPARATUS FOR PROVIDING A TIME CONTROLLED OUTPUT

BACKGROUND OF THE INVENTION

The present invention relates generally to time control circuits and more specifically to time control circuits where primary and secondary time sources are utilized.

There exist many applications where a critical time base is very important. Any application of devices where multiple devices operate independently in a coordinated manner with each independent device coordinated on the basis of an absolute time requires a very critical time base to be kept. An example of such an application is in decentralized traffic controllers. In a decentralized system, independent traffic controllers are located on individual street corners, and generally are independent from traffic controllers located on adjacent street corners. However, specific timing between street corners may be extremely desirable. That is, a specific offset between the "greens" at the consecutive corners or intersections may be desirable in order to reduce overall traffic delays.

Heretofore, the independent traffic controllers located on adjacent street corners needed to be connected to each other, e.g. by cable, to allow for synchronization. This is due primarily because of a generally poor time base availability. If each individual controller is to be truly independent, then strict control must be provided by a time base. Errors in time base of even three or four seconds can be noticeable for drivers approaching various street corners; therefore, it is of critical need to provide a strict time-controlled output.

U.S. Pat. No. 4,145,617 Lee, et al entitled Control Circuit for Providing Time-Selected Application of A.C. Power, issued Mar. 20, 1979 and assigned to the assignee of the present application uses A.C. power as a primary time source and a crystal oscillator as a backup. Generally, over a long term, the A.C. frequency will be more stable than a crystal oscillator subjected to a street corner environment of temperature fluctuation voltage differentiations due to nearby loads and other factors. Lee provides A.C. synchronization of a crystal oscillator with a D.C. battery as backup power to provide power for the circuitry. The Lee patent is hereby incorporated by reference.

However, where very critical timing relationships must be maintained, strict timing control must be maintained even down to one cycle of the primary time source. For example, if the primary time source is sixty (60) hertz, a loss of one cycle during switchover from primary (A.C.) to secondary (oscillator) time source would result in a time error of 1/60 of a second. Over a period of time, such errors could be cumulative and provide a less than strict time control base. Therefore, there is needed a time-control circuit providing accuracy down to even each cycle of the primary time source.

SUMMARY OF THE INVENTION

The present invention is an apparatus for providing a time-controlled output at a first frequency which is based primarily upon a primary time source providing a primary time signal at a second frequency which is equal to or greater than the first frequency, the apparatus is based secondarily upon a secondary time source, providing a secondary time signal at a third frequency which is equal to or greater than the second frequency. A counter is coupled to the secondary time signal providing a first output at approximately the first frequency, and a second output at approximately the second frequency. The counter is capable of being reset. A control circuit is coupled to the primary time signal, and coupled to the second output for providing a reset signal upon counting a predetermined number of pulses from the primary time signal, when the primary time source is operative, and also from the second output when the primary time source is not operative. The reset signal is coupled to the counter providing the reset of that counter. In this manner the time-controlled output is synchronized by the primary time source when the primary time source is operative and is synchronized by the secondary time source when the primary time source is not operative.

BRIEF DESCRIPTION OF THE DRAWINGS

The foregoing objects, advantages, construction and operation of the present invention will become more readily apparent in the following description and accompanying drawings in which.

DESCRIPTION OF THE PREFERRED EMBODIMENTS

Figure 1:
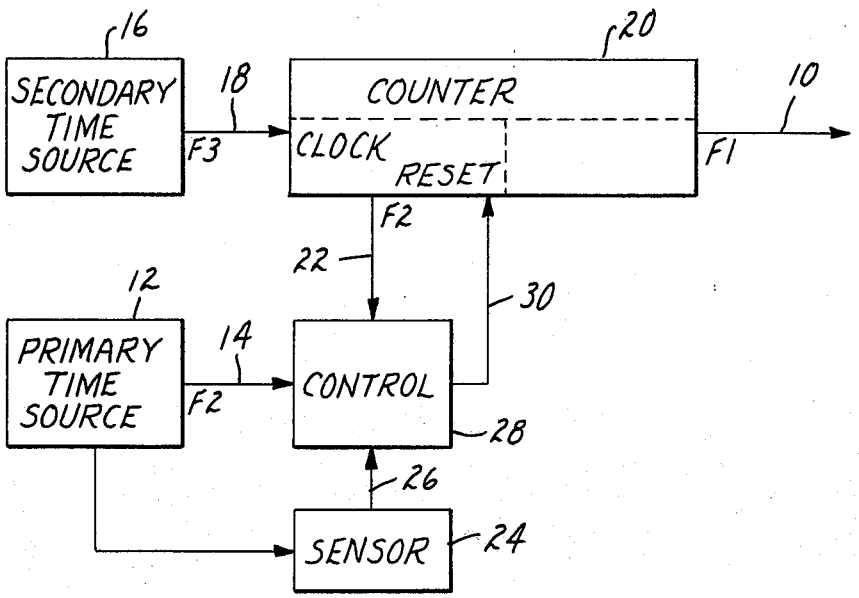
FIG. 1 is a block diagram of one embodiment of the present invention.

FIG. 1 shows a diagram of a control circuit providing one embodiment of the present invention. The circuit provides a time-controlled output 10 at a first frequency designated $f_1$ from a primary time source 12 providing a primary time signal 14 at a frequency $f_2$ and from a secondary time source 16 providing a secondary time signal 18 at a frequency $f_3$. It is contemplated that generally frequency $f_2$ would be greater than frequency $f_1$ and that frequency $f_3$ would be greater than frequency $f_2$. This being the case, the secondary time signal 18 would be fed into counter 20. Counter 20 would count the pulses produced by the secondary time signal 18 and provide output 22 at approximately frequency $f_2$. The counter would also continue to count the pulses on the secondary time signal 18 and also produce time-controlled output 10 at a frequency approximately $f_1$. The counter 20 contains suitable provision for being reset to zero or to another appropriate predetermined number. A sensor 24 is also connected to the primary time source 12 to provide a primary time operative signal 26. The primary time operative signal 26 is connected to control circuit 28, along with the primary time signal 14 and output 22 from counter 20. Control circuit 28 provides a reset signal 30 at a frequency of approximately $f_2$. Control circuit 28 operates such that when primary time operative signal 26 indicates that the primary time source 12 is operative, that the reset signal 30 will substantially follow primary time signal 14; however, when the primary timer operative signal 26 indicates that the primary time source 12 is not operative, then reset signal 30 would substantially follow output 22 from counter 20.

It can be seen that from this connection time-controlled output 10 as counted down by counter 20 from secondary time signal 18 would substantially be controlled by the stability of the secondary time source 16 absent any reset of the counter 20. However, when the primary time source 12 is operative and the sensor 24 provides primary time operative signal 26 to control circuit 28, that reset signal 30 will substantially follow the primary time signal 14. Thus, the counter 20 is reset according to the time base of the primary time signal 14. Thus, although the time-controlled output 10 is counted from the secondary time signal 18, its synchronization is controlled by the primary time signal 14 originating with the primary time source 12. In the embodiment in FIG. 1, the reset signal 30 would only reset that portion of counter 20 which is involved in counting down secondary time signal 18 from frequency $f_3$ to frequency $f_2$ present at output 22 and also from the primary time signal 14. The remainder of the counter 20 counts the signal down to frequency $f_1$ and need not be reset.

As indicated above, it is contemplated that frequency $f_2$ would be higher than frequency $f_1$; however, this need not be the case. Frequency $f_2$ could be identical to the frequency $f_1$ in which case the portion of counter 20 which counts the signal from the secondary time signal 18 from frequency $f_2$ to frequency $f_1$ would just be eliminated. In this case, the reset signal 30 would reset the entire counter 20. This being the case, output 22 and time-controlled output 10 both occurring at frequency $f_2$ (or frequency $f_1$ since they are equal) would be the same signal. Also, as indicated above, it is anticipated that $f_3$ would be higher than frequency $f_2$, but again this is not necessarily the case. If frequency $f_3$ were not greater than frequency $f_2$, then the portion of counter 20 which counts frequency $f_3$ into frequency $f_2$ would merely be a divide by one counter.

This unique arrangement of time sources and counters, including the control circuit 28 results in a time-control circuit in which the time-controlled output 10 is counted from a secondary time source 16, but is synchronized from a primary source 12 due to a reset signal 30. Reset signal 30 is supplied by the primary time source 12, when the primary time source is operative but from the secondary time source 16 when the primary time source is not operative. In this way, the time-controlled output 10 is synchronized by the primary time source 12 when it is operative, but is synchronized by itself (namely, secondary time source 16 which originally clocks the counter 20) when the primary time source 12 is not operative. This results in a time-control circuit in which control may be maintained upon the time-controlled output 10 even down to each cycle of the primary time source 12 since the synchronization control comes from the reset signal 30 which in turn is supplied from either the primary time signal 14 or from output 22 originating from the secondary time signal 18.

Figure 2:
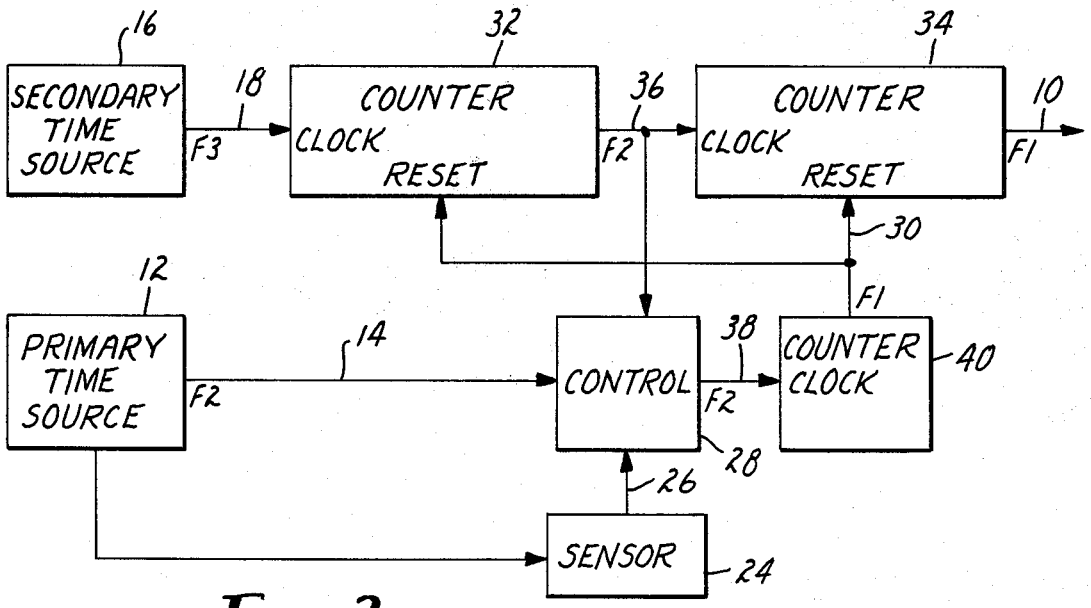
FIG. 2 is a block diagram of a second embodiment of the present invention.

Reference may now be had to the block diagram in FIG. 2 which illustrates a second embodiment of the present invention. In FIG. 2 we again have a time-controlled output signal 10 at a frequency $f_1$, a primary time source 12 providing a primary time signal 14 at a frequency $f_2$, a secondary time source 16 providing a secondary time signal 18 at frequency $f_3$, all as in FIG. 1. However, in FIG. 2, the counter 20 in FIG. 1 has been divided into two separate counters, illustrated by counter 32 and counter 34. Counter 32 counts down the secondary time signal 18 from frequency $f_2$ and provides output 36 at frequency $f_2$. Counter 34 then counts the output 36 from frequency $f_2$ down to the frequency $f_1$ of the time controlled output 10. Again a control circuit 28 selects either primary time signal 14 or output 36 (both at frequency $f_2$) to provide a reset time signal 38, also at $f_2$. Reset time signal 38 is fed into another counter 40 which counts the reset time signal 38 from frequency $f_2$ down to frequency $f_1$ supplying reset signal 30. Reset signal 30 is connected to the counters 32 and 34 and resets them providing the same synchronization to the counters driven by the secondary time source 16 as it provided in FIG. 1. The difference in FIG. 2 is that a counter is supplied at the output of control circuit 28 to count the reset signal 30 down to frequency $f_1$ to reset the entire counter 32 and 34. In this circuit, it is imperative that output 36 be supplied to the control circuit 28 so that reset time signal 38 will continue to be supplied to counter 40 should the primary time source 12 interrupt it. If this were not true, if primary time source 12 were to become inoperative, then to resume operation at a later time, the counter 40 would have a residual count not based upon the portion of the period that the primary time source 12 is in, and this could result in either the gain or loss of up to one-half ($\frac{1}{2}$) period of $f_1$.

Again, as in FIG. 1, in FIG. 2 it has been anticipated that frequency $f_2$ would be higher than frequency $f_1$, and frequency $f_3$ would be higher than frequency $f_2$. However, this is again not necessarily the case. If frequency $f_2$ and frequency $f_1$ were the same, then counter 34 would effectively be eliminated and counter 40 would also be eliminated resulting in the same circuit as in FIG. 1 when $f_2$ equals $f_1$. Correspondingly, if $f_3$ were equal to $f_2$, counter 32 may be eliminated.

Figure 3:
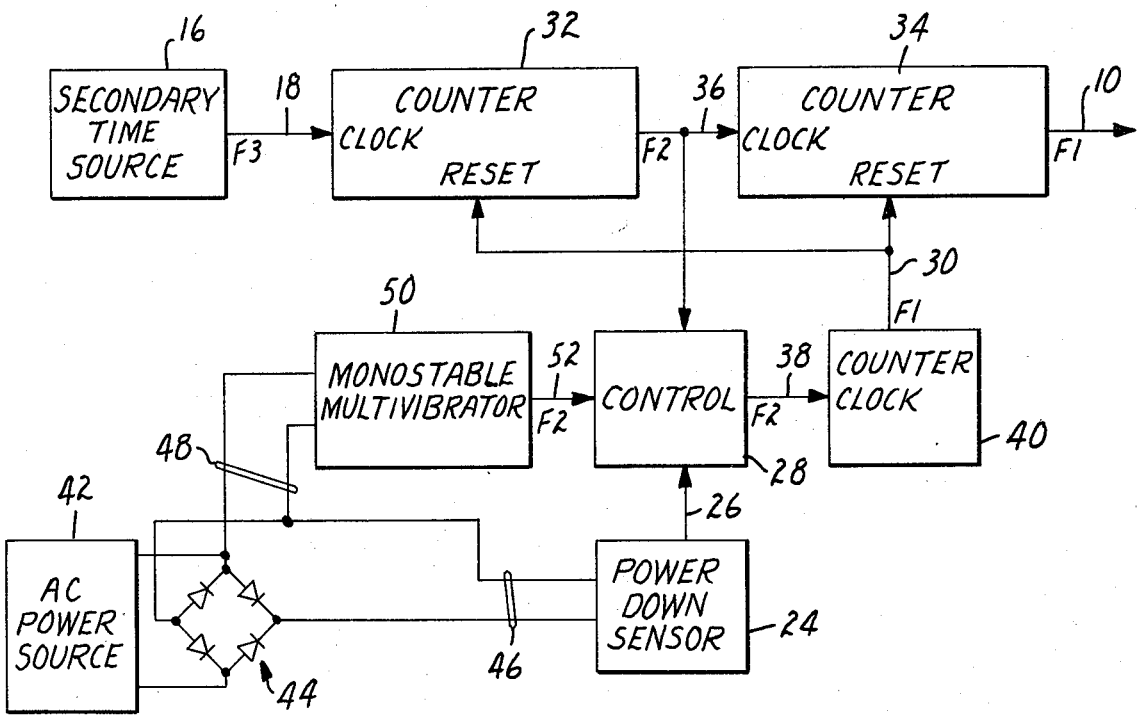
FIG. 3 is a more detailed block diagram of one embodiment of the present invention.

FIG. 3 illustrates with a block diagram much the same block diagram circuit as was described in FIG. 2. Again, in FIG. 3 we have a secondary time source 16, a secondary time signal 18 at frequency $f_3$, a counter 32 providing an output 36 at frequency $f_2$, counter 34 providing a time-controlled output 10 at frequency $f_1$. Again, we have control circuit 28 supplying reset time signal 38, counter 40 and reset signal 30. The control circuit 28 is supplied from sensor 24 and primary time operative signal 26. These parts of the diagram operate identically as in FIG. 2. FIG. 3 has expanded the primary time source origination. Instead of merely primary time source 12 as in FIG. 2, FIG. 3 shows an A.C. power source 42 such as the A.C. input power line operating in the United States at, for example, 60 hertz, and in some foreign countries at an approximate frequency of 50 hertz. The A.C. power source 42 feeds a bridge network 44 which supplies a full-wave rectified signal 46 to the sensor 24 and supplies a half-wave rectified signal 48 to a monostable multi-vibrator 50. The monostable multi-vibrator 50 takes the half-wave rectified signal from the A.C. power source 42 and provides a one-shot signal 52, the one-shot duration consisting of at least $\frac{1}{2}$ of the cycle of the A.C. power source 42, but less than one (1) cycle of the A.C. power source 42. This one-shot signal 52 comprises the primary time signal 14 of FIG. 2 and is connected to control circuit 28 in the same manner. In summary, FIG. 3 illustrates that the primary time source may be taken from the A.C. power input.

Figure 4:
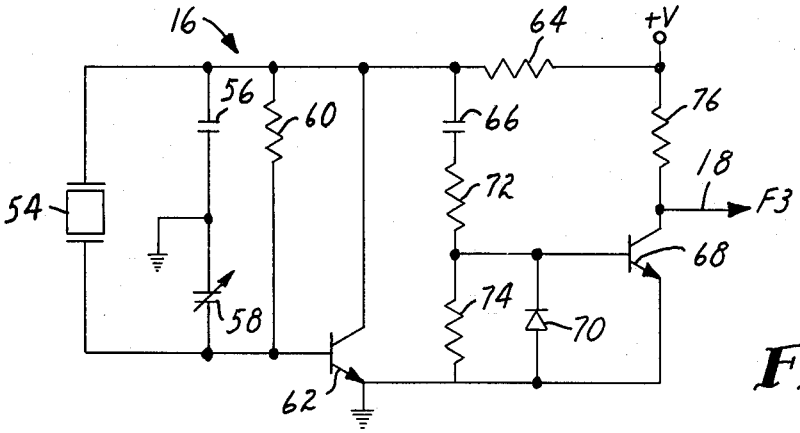
FIG. 4 is a detailed circuit diagram of the secondary time source.

FIG. 4 provides a detailed circuit diagram of one preferred embodiment of the secondary time source 16. In FIG. 4, the secondary time source 16 consists of a crystal-controlled oscillator. A standard parallel resonant crystal 54 is illustrated connected with capacitor 56, capacitor 58, resistor 60, transistor 62, and resistor 64. These components comprise a commonly known and standardly available self-biased crystal oscillator, also sometimes known as a Pierce oscillator. It is to be noted that transistor 62 must be of the radio frequency variety such as a 2N5179. Crystal 54 in one embodiment may be a 1.966080 megahertz crystal, capacitor 56 may be 47 picofarads, capacitor 58 may be an adjustable 5 to 80 picofarad capacitor to provide frequency adjustment, resistor 60 may be 100 kilohms and resistor 64 may be 4.7 kilohms connected to a plus 5 volt supply. Again, these circuit components and connections comprise a standardly available crystal oscillator. Capacitor 66, 0.1 microfarads, A.C. couples switching transistor 68, which may be a 2N5179. Diode 70, for example a 1N4148, presents reverse bias of transistor 68 of more than one diode drop. Resistor 72 and resistor 76, which all may be 4.7 kilohms, and resistor 74, which may be 47 kilohms, all also bias transistor 68. Switching transistor 68 provides a pulse shaping switching action which helps produce a pulse stream more approaching a square wave from the crystal oscillator and buffers the oscillator from other circuit elements. The collector of transistor 68 provides the secondary time signal 18 at a frequency of $f_3$.

Figure 5:
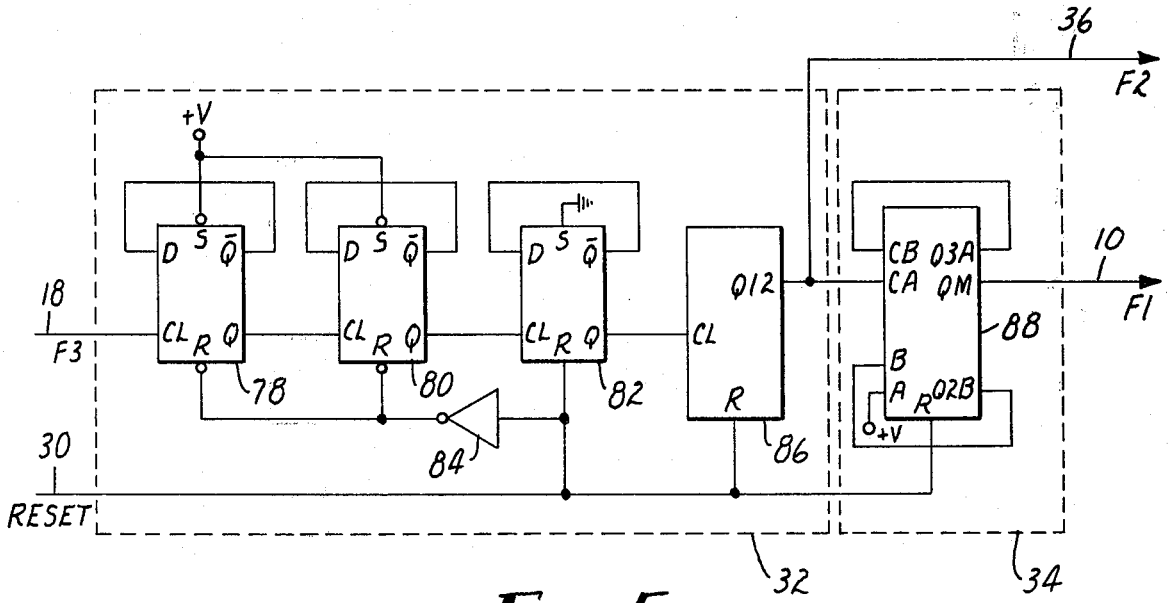
FIG. 5 is a detailed circuit diagram of the secondary time counter.

FIG. 5 provides a detailed schematic diagram of counters 32 and 34 in FIG. 2. Counter 32 receives the secondary time signal 18 at a frequency of $f_3$ and also receives reset signal 30. Counter 32 provides output 36 at a frequency of $f_2$ to counter 34; counter 34 also receives as an input reset signal 30 and produces time-controlled output 10 at frequency $f_1$.

Counter 32, shown comprised of a series of three divide by two counters made up of D-type flip-flops 78, 80 and 82 connected in a series. Flip-flops 78 and 80 are 74LS74 TTL devices in order to provide sufficient switching time. D-type flip-flop 82 is a 4013 CMOS type flip-flop to provide for low power which may be utilized because the frequency requirements on flip-flop 82 are less. Inverter 84 is provided to alter the level of the reset signal 30 required by the different type flip-flops. The output of flip-flop 82 is connected to the clock input of counter 86, which may, for example, a standard 14 bit binary counter whose output 36 is connected to the Q12 output stage. This counter 86 may be a Motorola MC14020B as described in *Motorola CMOS Integrated Circuits,* Series C, published by Motorola, Inc. in 1978. Reset signal 30 is also connected to the reset input of counter 86.

Counter 34 comprises a single divide by 60 counter, in this case an industrial time base generator, such as a Motorola MC14566B as described in *Motorola CMOS Integrated Circuit* series C, published by Motorola, Inc. in 1978. Output 36 is connected to the CA input of counter 88, the Q3A and CB terminals are connected together as are the Q2B and B terminals are connected together. Control time output 10 comes from the QM output of counter 88. This circuit essentially provides a divide by 60 counter, but also provides for alternate divide by 50 construction should the A.C. power source be operating on 50 hertz instead of the standard United States 60 hertz.

Figure 6:
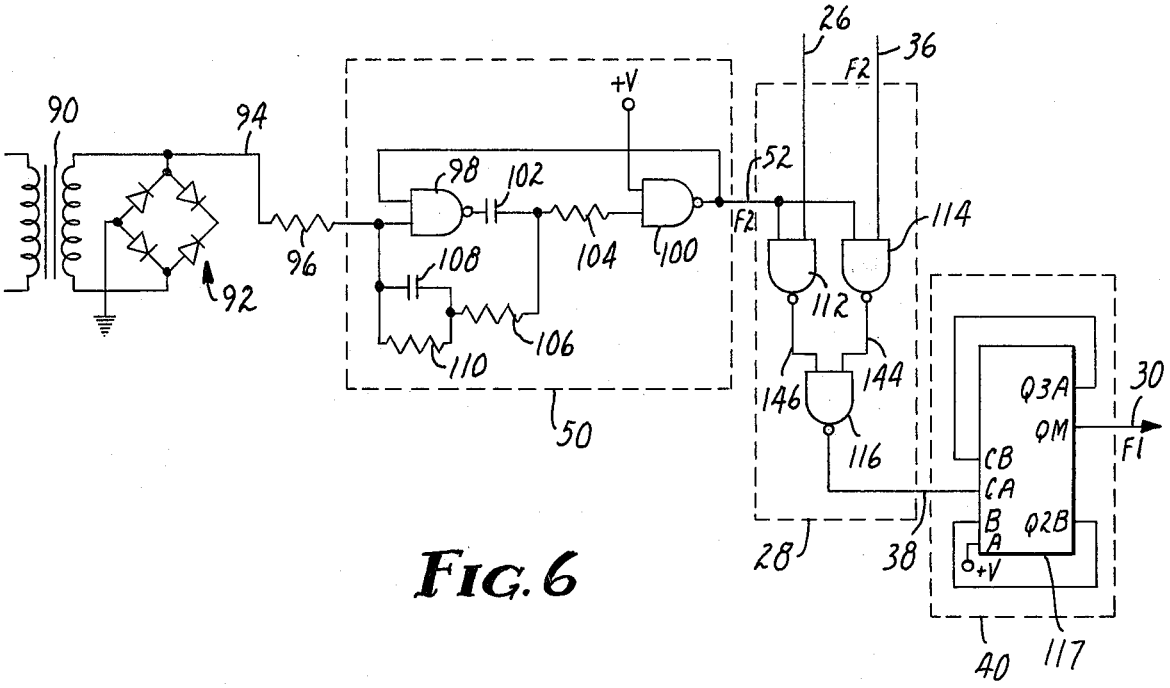
FIG. 6 is a detailed circuit diagram showing the primary time source input, the control circuit, and including a primary time source counter.

FIG. 6 is a detailed diagram of the primary time source input including the monostable multivibrator 50 and also a detailed diagram of control circuit 28 and counter 40 from FIG. 3. The A.C. power source is shown at the secondary of a transformer 90 connected to a full-wave rectifier 92. The rectifier 92 is tapped at point 94 to provide a half-wave rectified signal. The use of the half-wave rectified tap 94 from the full-wave rectifier 92 prevents back biasing of the subsequent circuit inputs. The half-wave rectified signal passes through resistor 96, 220 kilohms, and into the monostable multivibrator 50. The monostable multivibrator 50 is a standard circuit and, in this case, constructed from two NAND gates 98 and 100 connected with capacitor 102, 0.01 microfarads, resistor 104, 22 kilohms, and resistor 106, 1.5 megaohm. Capacitor 108, 0.01 microfarad provides for noise suppression on the input and resistor 110, 220 kilohm, provides a D.C. path to discharge capacitor 108 in the event of a primary power failure which would result in essentially an open of point 94 from the full-wave rectifier 92. The output of NAND gate 100 provides one-shot signal 52 which ranges from greater than one-half cycle of A.C. power source to less than one full cycle of the A.C. power source.

Control circuit 28 consists of two input NAND gates, 112, 114 and 116. One input of NAND gates 112 and 114 are connected to one-shot signal 52. The other input of NAND gate 112 is connected to primary time operative signal 26. The other input of NAND gate 114 is connected to output 36 in FIG. 3. The two outputs of NAND gate 112 and 114 provide the inputs for NAND gate 116; the output of NAND gate 116 comprising the reset time signal 38. It can be seen that when primary time operative 26 is active, i.e. a logical high, that reset time signal 38 will substantially follow one-shot signal 52. It can also be seen that when primary time operative signal 26 is inactive, i.e. a logical low, reset time signal 38 will substantially follow output 36. In this regard, it is important to note that the trailing edge of wave forms 52 and 36, and consequently, the trailing edge of wave form 38, control the exact timing of the reset count, thus it is the trailing edges which must keep track.

Counter 40 is identical in component and operation to counter 34 described in FIG. 5. Counter 40 receives as an input, reset time signal 38 at a frequency of approximately $f_2$ and supplies as an output, reset signal 30 at approximately the frequency $f_1$.

Figure 7:
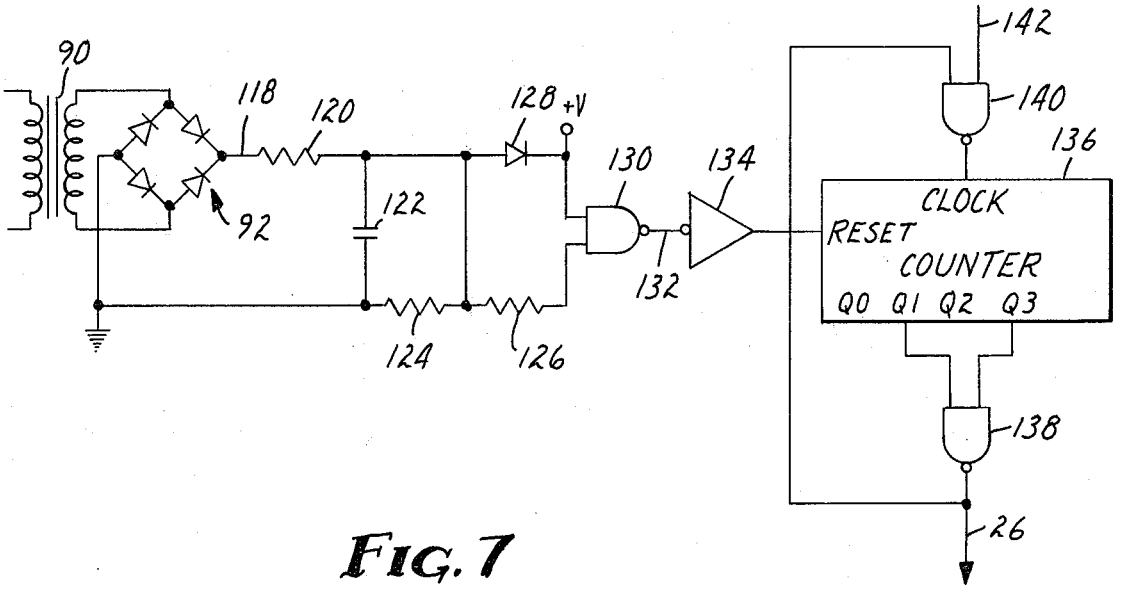
FIG. 7 is a detailed circuit diagram of the primary time source sensor.

FIG. 7 provides a detailed diagram of the sensor 24. Again, as in FIG. 6, A.C. input power supplied and through transformer 90 and full-wave rectifier 92. Sensor 24 takes the full-wave rectified signal 118 through resistor 120, 220 kilohm, capacitor 122, 0.01 microfarads, resistor 124, 50 kilohm, resistor 126, 22 kilohm, and diode 128, such as an 1N4148, connected through the +5 volt supply to NAND circuit 130. Circuit 130 is a Schmidt trigger circuit which senses in the input voltage and supplies a low output 130 each half cycle of A.C. power when A.C. power has not failed. When A.C. power has failed, circuit 130 provides a solid logical high output. This is fed through inverter 134 to constantly reset a counter 136 when A.C. power has not failed. Counter 136, when a specific count is reached, drives NAND circuit 138 producing a low on primary time operative signal 26. Counter 136 is also driven by two input NAND circuit 140, one of whose inputs is primary time operative signal 26. The other input to NAND circuit 140 is a source of constant pulses 142 which will repeatedly attempt to increment counter 136. If primary time is operative, signal 132 will be pulsing low and counter 136 will be continually reset. If primary time is inoperative, signal 132 will stay high, counter 136 will no longer be continually reset and upon the appropriate predetermined count, less than one cycle of A.C. power, NAND gate 138 will be activated and primary time operative signal 26 will be driven low. The time required for primary time input signal 26 to go low and hence the count to be achieved in counter 136 depends upon the input stability of the A.C. power source.

Figure 8:
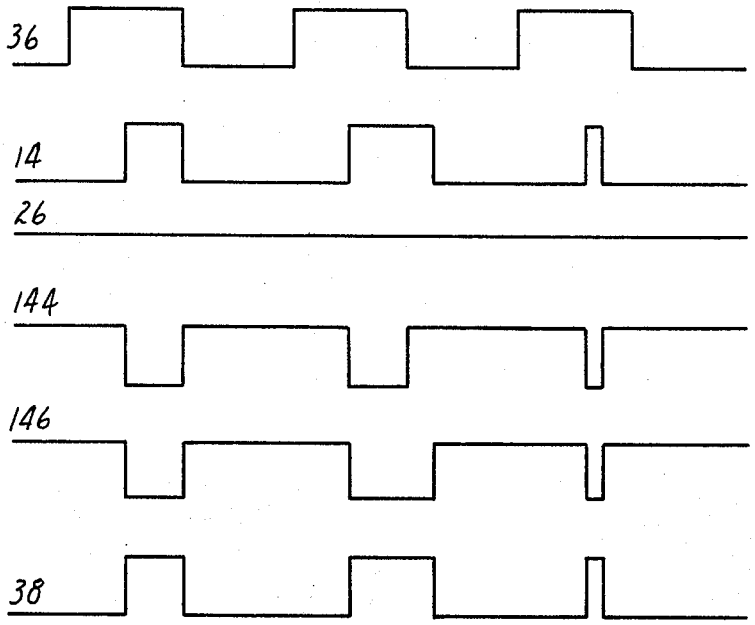
FIG. 8 is a timing diagram showing the operation of the control circuit when primary time source is operative.

The operation of the control circuit 28 in FIG. 6 may be more readily understood by considering the timing diagram in FIG. 8. The timing diagram illustrated in FIG. 8 represents the case where primary input power is operative and hence, the trailing edge of reset time signal 38 should follow the trailing edge of primary time signal 14, or in the case of FIG. 6, one-shot signal 52. Illustrated are the output 36 from the counter at frequency $f_2$, the primary time signal 14, or in the case of FIG. 6, one-shot signal 52, the primary time operative signal 26 and reset time signal 38. In addition, the output 146 of NAND gate 112 is illustrated as is the output 144 of NAND gate 114. It can readily be seen from FIG. 8 that with primary time operative, i.e., primary operative signal 26 at a logical high, that signal 144 represents the NANDing of signals 36 and 52. Likewise, it can be seen that signal 146 represents the inversion of signal 52. The combining of signals 144 and 146 in NAND gate 116 provides output 38, the trailing edge of which is consistent with the timing of the primary time signal 14. Thus, when primary time is operative, the counters are reset to provide synchronization with the primary time source.

Figure 9:
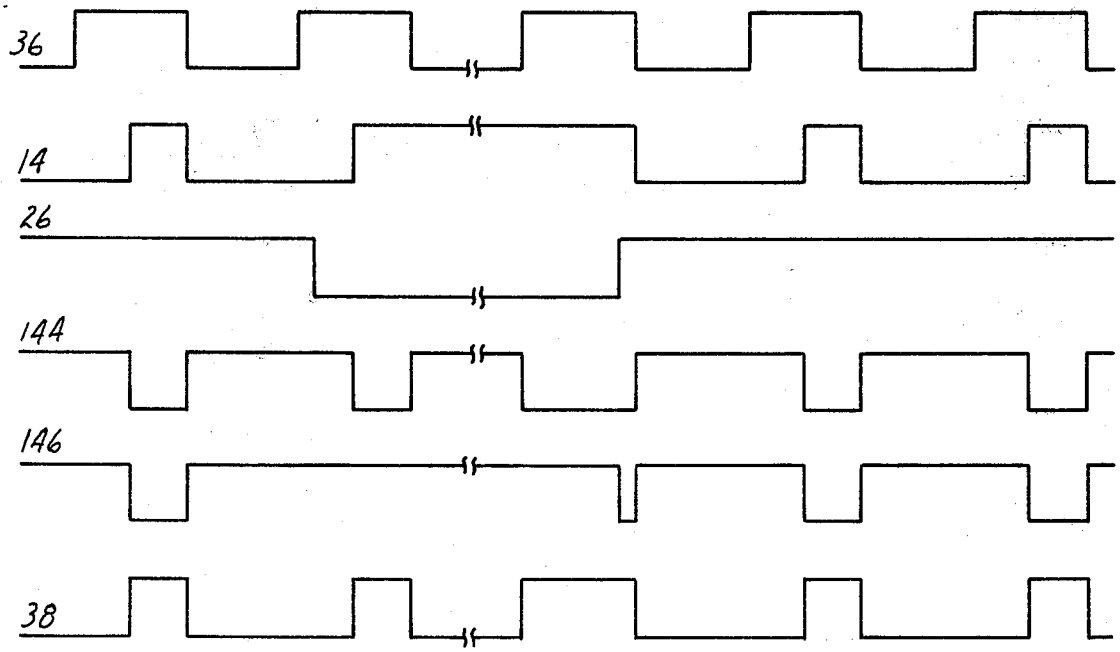
FIG. 9 is a timing diagram showing the operation of the control circuit when primary time source is not operative for some period of time.

FIG. 9 provides a timing diagram illustrating the same signals and providing a period of time when primary power is not operative. This can be seen from primary time operative signal 26 going low, in which case, signal 146 goes high for the duration, signal 144 represents an inversion of output 36 from the counters because primary time signal 14 has gone high for the duration because primary time is not operative. In this manner, it can be seen that reset time signal 38's trailing edge follows output 36 from the counters. Thus, it can be seen that while primary time is not operative, the counters are reset based upon the counters themselves. Thus, the time controlled output 10 is synchronized by the secondary time source 12.

Thus, it can be seen that there has been shown and described a novel apparatus for providing a time-controlled output. It is to be understood, however, that various changes, modifications and substitutions in the forms and details of the described apparatus can be made by those skilled in the art without departing from the scope of the invention as defined by the following claims.

What is claimed is:

1. An apparatus for providing a time controlled output at a first frequency based primarily upon a primary time source providing a primary time signal at a second frequency which is equal to or greater than said first frequency, comprising:

an oscillator producing an oscillator time digital signal at a third frequency which is equal to or greater than said second frequency;

a counter coupled to said oscillator time digital signal for counting a predetermined number of pulses of said oscillator time digital signal and producing as an output said time controlled output, said counter having a provision for being reset;

a primary time sensor coupled to said primary time source providing a primary time operative signal indicative of said primary time source being operative; and a control circuit coupled to said time controlled output, coupled to said primary time signal and coupled to said primary time operative signal, said control circuit producing a reset signal responsive to said primary time signal when said primary operative time signal indicates said primary time source is operative and responsive to said time controlled signal when said primary time operative signal indicates said primary time source is not operative;

said reset signal being operatively coupled to said counter providing said provision for being reset;

whereby said time controlled output is synchronized by said primary time source when said primary time source is operative and is synchronized by said oscillator when said primary time source is not operative.

2. An apparatus as in claim 1 wherein said oscillator utilizes a crystal for a time base.

3. An apparatus as in claim 1 wherein said control circuit comprises:

a first NAND gate having two inputs and an output with one of said two inputs being coupled to said primary time signal and with the other of said two inputs being coupled to said primary time operative signal;

a second NAND gate having two inputs and an output with one of said two inputs being coupled to said primary time signal and with the other of said two inputs being coupled to said time controlled output; and a third NAND gate having two inputs and an output with said two inputs being individually coupled to said outputs of said first and said second NAND gates and said output of said third NAND gate being said reset signal.

4. An apparatus as in claim 1 wherein said first frequency is approximately one hertz and said second frequency is approximately sixty hertz.

5. An apparatus as in claim 1 wherein said first frequency is approximately one hertz and said second frequency is approximately fifty hertz.

6. An apparatus for providing a time controlled output at a first frequency based primarily upon a primary time source providing a primary time signal at a second frequency which is equal to or greater than said first frequency, comprising:

an oscillator producing an oscillator time digital signal at a third frequency which is equal to or greater than said second frequency;

an oscillator counter coupled to said oscillator time digital signal for counting a first predetermined number of pulses of said oscillator time digital signal and producing a first counter output at approximately said second frequency, and for counting a second predetermined number of pulses of said oscillator time digital signal and producing a second counter output at approximately said first frequency being said time controlled output, said oscillator counter having a provision for being reset;

a primary time sensor coupled to said primary time source providing a primary time operative signal indicative of said primary time source being operative;

a control circuit coupled to said first counter output, coupled to said primary time signal and coupled to said primary time operative signal, said control circuit producing a reset time signal responsive to said primary time signal when said primary time operative signal indicates said primary time source is operative and responsive to said first counter signal when said primary time operative signal indicates said primary time source is not operative; and a reset counter coupled to said reset time signal for counting said second predetermined number of pulses of said reset time signal producing a reset pulse at approximately said first frequency;

said reset pulse being operatively coupled to said oscillator counter providing said provision for being reset;

whereby said time controlled output is synchronized by said primary time source when said primary time source is operative and is synchronized by said oscillator when said primary time source is not operative.

7. An apparatus as in claim 6 wherein said oscillator utilizes a crystal for a time base.

8. An apparatus as in claim 6 wherein said control circuit comprises:

a first NAND gate having two inputs and an output with one of said two inputs being coupled to said primary time signal and with the other of said two inputs being coupled to said primary time operative signal;

a second NAND gate having two inputs and an output with one of said two inputs being coupled to said primary time signal and with the other of said two inputs being coupled to said first counter output; and a third NAND gate having two inputs and an output with said two inputs being individually coupled to said outputs of said first and said second NAND gates and said output of said third NAND gate being said reset time signal.

9. An apparatus as in claim 6 wherein said first frequency is approximately one hertz and said second frequency is approximately sixty hertz.

10. An apparatus as in claim 6 wherein said first frequency is approximately one hertz and said second frequency is approximately fifty hertz.

11. An apparatus for providing a time controlled output at a first frequency, comprising:

a half-wave rectifier coupled to an A.C. power source operating at a second frequency which is equal to or greater than said first frequency, said half-wave rectifier providing a half-wave rectified signal at said second frequency;

a monostable multivibrator coupled to said half-wave rectified signal producing an A.C. time digital signal having a duration of greater than one-half cycle of said A.C. power source and less than one cycle of said A.C. power source;

an oscillator producing an oscillator time digital signal at a third frequency which is equal to or greater than said second frequency;

an oscillator counter coupled to said oscillator time digital signal for counting a first predetermined number of pulses of said oscillator time digital signal and producing a first counter output at approximately said second frequency, and for counting a second predetermined number of pulses of said oscillator time digital signal and producing a second counter output at approximately said first frequency being said time controlled output, said oscillator counter having a provision for being reset;

a power sensor coupled to said A.C. power source providing a power operative signal indicative of said A.C. power source being operative;

a control circuit coupled to said first counter output, coupled to said A.C. time digital signal and coupled to said power operative signal, said control circuit producing a reset time signal responsive to said A.C. time digital signal when said power operative signal indicates said A.C. power source is operative and responsive to said first counter signal when said power operative signal indicates said A.C. power source is not operative; and a reset counter coupled to said reset time signal for counting said second predetermined number of pulses of said reset time signal producing a reset pulse at approximately said first frequency;

said reset pulse being operatively coupled to said oscillator counter providing said provision for being reset;

whereby said time controlled output is synchronized by said A.C. power source when said A.C. power source is operative and is synchronized by said oscillator when said A.C. power source is not operative.

12. An apparatus as in claim 11 wherein said oscillator utilizes a crystal for a time base.

13. An apparatus as in claim 11 wherein said control circuit comprises:

a first NAND gate having two inputs and an output with one of said two inputs being coupled to said A.C. time digital signal and with the other of said two inputs being coupled to said power operative signal;

a second NAND gate having two inputs and an output with one of said two inputs being coupled to said A.C. time digital signal and with the other of said two inputs being coupled to said first counter output; and a third NAND gate having two inputs and an output with said two inputs being individually coupled to said outputs of said first and said second NAND gates and said output of said third NAND gate being said reset time signal.

14. An apparatus as in claim 11 wherein said first frequency is approximately one hertz and said second frequency is approximately sixty hertz.

15. An apparatus as in claim 11 wherein said first frequency is approximately one hertz and said second frequency is approximately fifty hertz.

16. An apparatus for providing a time controlled output at a first frequency based primarily upon a primary time source providing a primary time signal at a second frequency which is equal to or greater than said first frequency, comprising in combination:

oscillating means for producing an oscillator time digital signal at a third frequency which is equal to or greater than said second frequency;

oscillator counter means coupled to said oscillator time digital signal for counting a first predetermined number of pulses of said oscillator time digital signal and producing a first counter output at approximately said second frequency, and for counting a second predetermined number of pulses of said oscillator time digital signal and producing a second counter output at approximately said first frequency being said time controlled output, said oscillator counter having a provision for being reset;

sensing means coupled to said primary time source for providing a primary time operative signal indicative of said primary time source being operative;

control means coupled to said first counter output, coupled to said primary time signal and coupled to said primary time operative signal, said control means for producing a reset time signal responsive to said primary time signal when said primary time operative signal indicates said primary time source is operative and responsive to said first counter signal when said primary time operative signal indicates said primary time source is not operative; and reset counter means coupled to said reset time signal for counting said second predetermined number of pulses of said reset time signal producing a reset pulse at approximately said first frequency;

said reset pulse being operatively coupled to said oscillator counting means providing said provision for being reset.

17. An apparatus for providing a time-controlled output at a first frequency based primarily upon a primary time source providing a primary time signal at a second frequency which is equal to or greater than said first frequency and based secondarily upon a secondary time source providing a secondary time signal at a third frequency which is equal to or greater than said second frequency, comprising:

a counter coupled to said secondary time signal providing a first output at approximately said first frequency and a second output at approximately said second frequency, said counter being capable of being reset; and a control circuit coupled to said primary time signal and coupled to said second output for providing a reset signal upon counting a predetermined number of pulses from said primary time signal when said primary time source is operative and also from said second output when said primary time source is not operative;

said reset signal being coupled to said counter providing said reset of said counter;

whereby said time control output is synchronized by said primary time source when said primary time source is operative and is synchronized by said secondary time source when said primary time source is not operative.

* * * * *